US007238003B2

(12) United States Patent
Synnott et al.

(10) Patent No.: US 7,238,003 B2
(45) Date of Patent: Jul. 3, 2007

(54) VANE ATTACHMENT ARRANGEMENT

(75) Inventors: Remy Synnott, St. Jean-Sur-Richelieu (CA); Nicolas Grivas, Dollard des Ormeaux (CA); Alan Juneau, Mount Royal (CA); David Glasspoole, St. Lambert (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 339 days.

(21) Appl. No.: 10/923,680

(22) Filed: Aug. 24, 2004

(65) Prior Publication Data

US 2006/0045745 A1 Mar. 2, 2006

(51) Int. Cl.
*F01D 25/26* (2006.01)
*F03B 1/04* (2006.01)

(52) U.S. Cl. ..... 415/139; 415/190; 415/209.2; 29/889.22

(58) Field of Classification Search ..... 415/135–139, 415/174.2, 189, 190, 209.2, 209.3, 209.4, 415/210.1; 277/637, 641, 644, 647; 29/451, 29/469, 889.22
See application file for complete search history.

(56) References Cited

U.S. PATENT DOCUMENTS 2,801,822 A 8/1957 Speed
3,365,173 A 1/1968 Lynch et al.
3,807,892 A 4/1974 Frei et al.
3,990,807 A 11/1976 Sifford
3,997,280 A 12/1976 Germain
4,050,843 A * 9/1977 Needham et al. ..... 415/136
4,194,869 A 3/1980 Corcokios
4,384,822 A 5/1983 Schweikl et al.
4,552,509 A * 11/1985 Schweikl et al. ..... 415/135
4,907,944 A 3/1990 Kroger et al.
5,149,250 A 9/1992 Plemmons et al.
5,192,185 A 3/1993 Leonard
5,232,340 A 8/1993 Morgan
5,669,757 A 9/1997 Brackett
5,738,490 A * 4/1998 Pizzi ..... 415/139
6,095,750 A * 8/2000 Ross et al. ..... 415/189
6,375,415 B1 4/2002 Burdgick
6,517,313 B2 * 2/2003 Rogers ..... 415/137
6,537,022 B1 3/2003 Housley et al.
6,655,911 B2 12/2003 Bekreney

FOREIGN PATENT DOCUMENTS

EP 0018892 A1 * 11/1980 ..... 415/139

* cited by examiner

*Primary Examiner*—Edward K. Look
*Assistant Examiner*—Dwayne J White
(74) *Attorney, Agent, or Firm*—Ogilvy Renault LLP

(57) ABSTRACT

A simplified vane mounting arrangement by which a vane ring can be pre-assembled to an inner support ring before being installed in an outer casing.

33 Claims, 3 Drawing Sheets

VANE ATTACHMENT ARRANGEMENT

TECHNICAL FIELD

The invention relates generally to gas turbine engines and, more particularly, to an improved vane mounting arrangement.

BACKGROUND OF THE ART

In a typical turbine vane mounting arrangement, the vane ring segments are first fixedly mounted to an intermediate inner ring, known as a squirrel cage, or alternatively directly to the outer case by means of a forward hook and an aft hook extending from the outer band of each segment. Then, the inner band of the segments is mounted to a two-piece inner ring. Due to assembly geometry, the inner ring must necessarily be provided in two pieces and assembled, such as by bolting, to the vane ring. That is because it is not possible to simultaneously insert two ends of a rigid object into fixed geometry endpoints.

The above assemblies require that several parts be bolted or otherwise fixedly secured together which significantly increase the weight and the cost of the overall vane assembly.

SUMMARY OF THE INVENTION

It is therefore an object of this invention to provide an improved vane ring mounting arrangement suited for use in a gas turbine engine.

In one aspect, the present invention provides a vane mounting arrangement for a gas turbine engine, comprising an outer casing ring, and a segmented vane ring pre-assembled on a one-piece inner ring to form therewith a vane ring sub-assembly adapted to be directly mounted to the outer casing ring as a unitary component.

In another aspect, the present invention provides a stationary vane ring assembly for a gas turbine engine, comprising a vane ring having a number of circumferentially spaced-apart vanes extending radially between inner and outer arcuate bands, the vane ring being mounted to an inner ring to form therewith a pre-assembled vane ring sub-assembly, the pre-assembled vane ring sub-assembly being mountable as a unit directly to an outer casing.

In another aspect, the present invention provides a vane mounting arrangement comprising: an outer casing, a vane ring comprising circumferentially spaced-apart vanes extending radially between inner and outer arcuate bands, the vane ring being hooked at one of a front and a rear end thereof directly to the outer casing while being floatingly maintained in radial abutment relationship with the outer casing at another one of said front and rear ends by gas flow pressure during use.

In another aspect, the present invention provides a method of assembling a stage of stationary gas turbine engine vanes, comprising the steps of: a) assembling a number of vane ring segments to a one-piece inner ring to form a pre-assembled vane ring sub-assembly, and then b) installing the pre-assembled vane ring sub-assembly as a unit in an outer casing ring. In a further aspect, the present invention provides a vane assembly for a gas turbine engine, the vane comprising a plurality of airfoils extending between an inner platform and an outer platform; at least one hook extending radially outward from the outer platform and adpated to hookingly engage the gas turbine engine; and at least one reaction leg extending radially outward from the outer platform and adapted to abut the gas turbine engine when the hook hookingly engages the gas turbine engine, wherein the hook and reaction leg are positioned on the vane assembly such that, in use, pressure exerted on the vane assembly by combustion gases exiting an upstream combustor urges the reaction leg into contact with the gas turbine engine.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
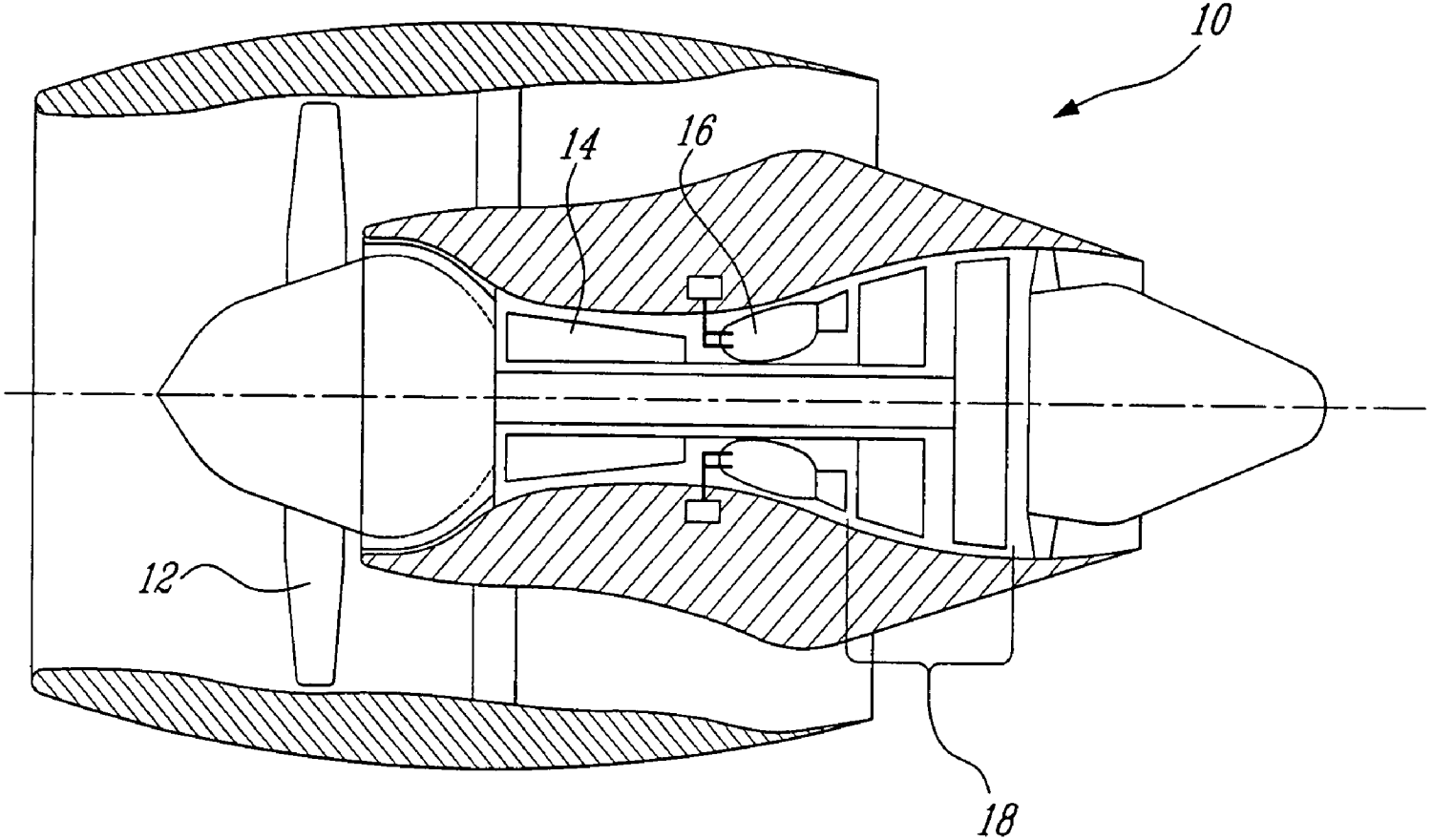
FIG. 1 is a schematic, longitudinal sectional view of a turbofan gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
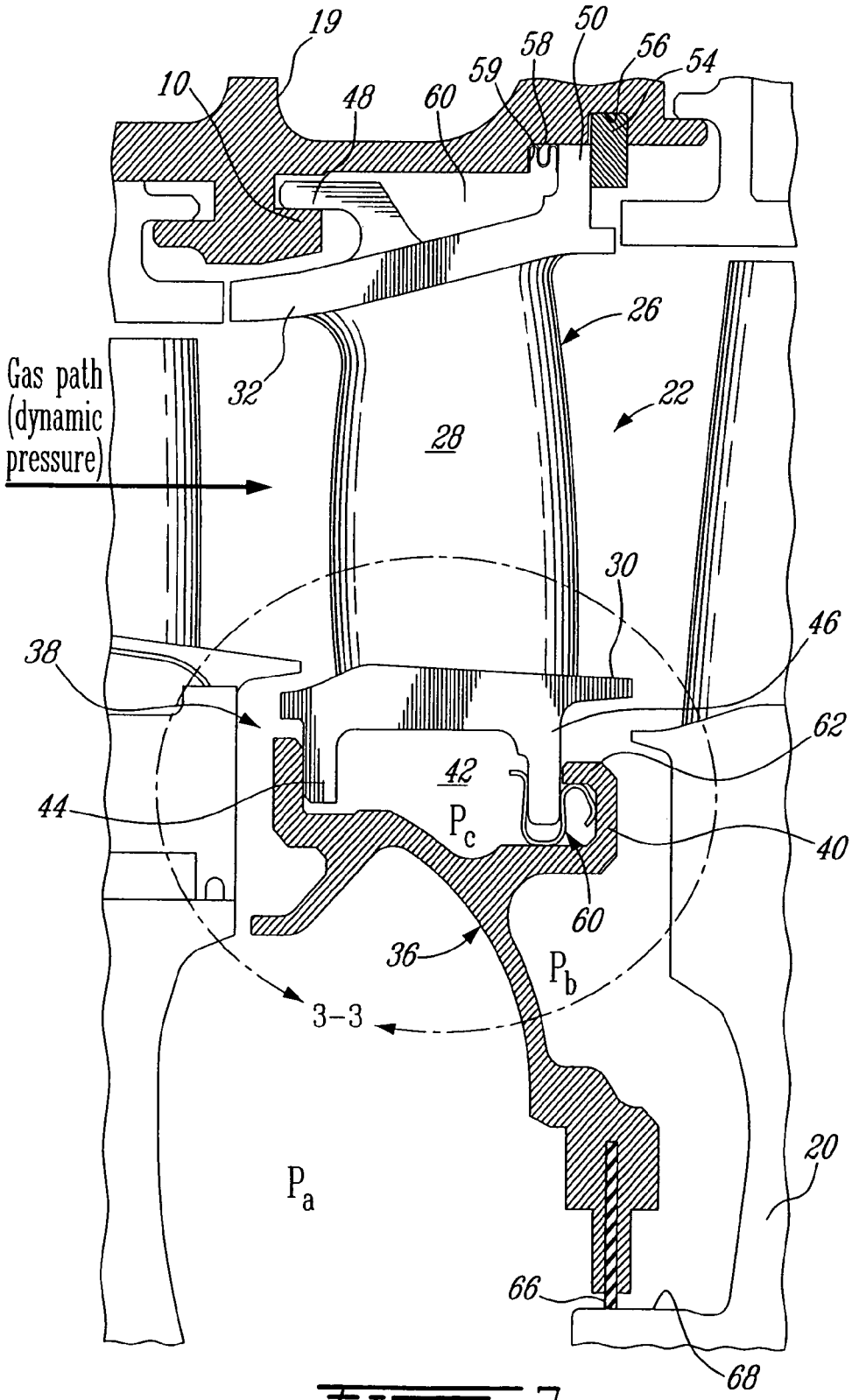
FIG. 2 is a side view of a vane ring mounting arrangement of the engine shown in FIG. 1 in accordance with an embodiment of the present invention.

As shown in FIG. 2, the gas turbine section 18 has one or more stages disposed within an outer casing, such as a turbine support case 19. Each turbine stage commonly comprises a turbine rotor 20 that rotates about a centerline axis of the engine 10 and a stationary vane ring 22 for channelling the combustion gases to the turbine rotor 20. The vane ring 22 is commonly segmented around the circumference thereof with each vane ring segment 26 having a plurality of circumferentially spaced-apart turbine vanes 28 (only one of which is shown in FIG. 2) extending radially between inner and outer arcuate bands 30 and 32 that define the radial flow path boundaries for the hot combustion gases flowing through the vane ring 22.

The vane ring segments 26 are pre-assembled onto a one-piece inner ring 36 prior to being mounted into the turbine support case 19. The use of a one-piece inner ring is preferred to facilitate the vane assembly procedure while providing for a simpler, lighter and cheaper vane mounting arrangement as compared to conventional bolted multi-pieces inner supports. In the past, multi-pieces inner supports have been required because the vane segments were first secured to the outer intermediate ring and then bolted or otherwise attached to the inner support.

As shown in FIG. 2, the one-piece inner ring 36 is integrally provided with axially spaced-apart radially outwardly extending flanges 38 and 40 defining therebetween a radially outwardly facing annular groove or cavity 42 for receiving the circumferentially adjoining vane ring segments 26. The inner band 30 of each vane ring segment 26 is provided with integral forward and aft radially inwardly extending legs 44 and 46 adapted to be received in cavity 42 between the axially spaced-apart annular flanges 38 and 40.

As will be seen hereinafter, the turbine support case 19 and the outer band 32 of the vane ring segments 26 have a mounting interface which is specifically designed to permit the vane ring segments 26 and the one-piece inner ring 36 to be pre-assembled and then mounted as a single unit directly to the case 19. For that purpose, the outer band 32 is integrally provided with a forward retention hook 48 and an aft radially outwardly extending reaction leg 50. The forward retention hook 48 is adapted to be axially slid in engagement with a corresponding forward annular support flange 52 integrally formed on the inner surface of the annular turbine support case 19. The support flange 52 is spaced radially inwardly from the inner surface of the case 19 to form therewith an annular groove in which is axially received the forward retention hook 48 of the outer band 32. The forward retention hook 48 and the support flange 52 thus provide an axial tongue and groove arrangement which radially support the forward end of the vane ring segments 26.

According to the illustrated embodiment, the aft reaction leg 50 has no intrinsic axial connection to case 19 and only abuts against the inner surface of the case 19 in a radially outward direction. This provides a non-secured fixing or floating connection at the aft end of the vane ring 22. There is thus no special action required to fix the aft leg 50. This mounting arrangement rather relies on the dynamic gas pressure of the combustion gases flowing between the inner and outer bands 30 and 32 to secure the vane ring 22 in place. In use, the aft leg 50 is pushed radially outwardly against the case 19 as the gas path dynamic pressure tends to rotate the vanes 28 about the hook point formed by the forward retention hook 48 and the forward flange 52.

After the forward retention hook 48 has been axially slid in engagement with the forward flange 52 of the case 19, an annular retainer 54 is mounted in a radially inwardly facing slot 56 defined in the case 19 to form an axial aft stop against which the aft leg 50 can abut to retain the vane ring 22 against axially aft movement during engine operation. A W-shaped annular spring seal 58 extends between a radially inwardly extending shoulder 59 defined in the inner surface of the case 19 and a front face of the aft reaction leg 50. The W-seal 58 seals the air cooling cavity (not indicated) defined between the outer band 32 and the case 19 and urges the aft reaction leg 50 against the axial retainer 54 to help maintain aft reaction leg 50 generally abutting case 19 while the engine is not in operation (i.e. when there is no dynamic gas pressure exerted on the vane ring 22).

Figure 3:
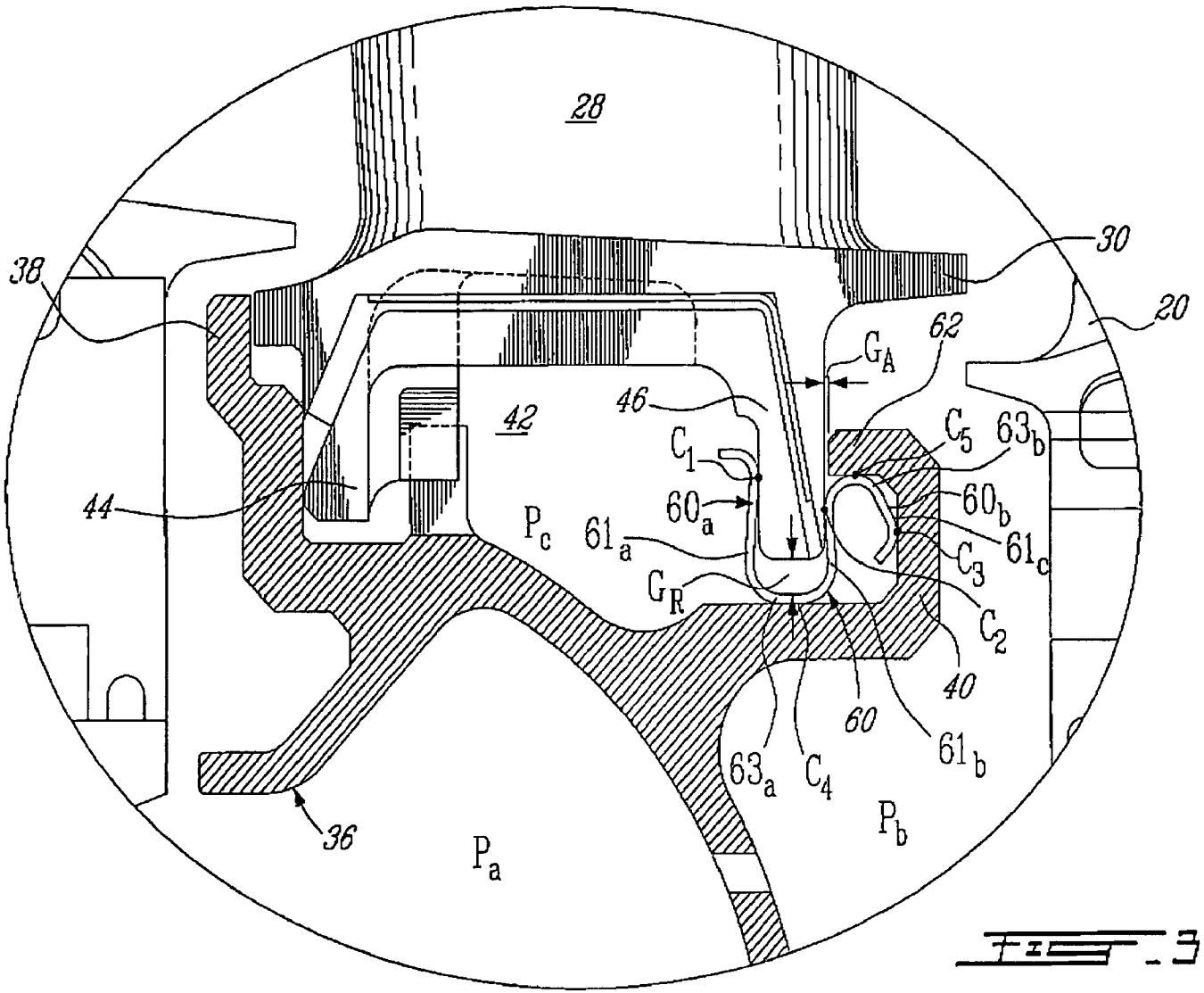
FIG. 3 is an enlarged side view of a radial inner portion of the vane ring mounting arrangement shown in FIG. 2.

An annular S-shaped spring seal 60 is installed in the annular cavity 42 of the inner ring 36 over the aft leg 46 of the inner band 30 to seal cavity 42 and provide a forward spring force to keep the vane ring 22 in place when the engine 10 is shut down (i.e. when there is no dynamic gas pressure exerted on the vane ring 22). As shown in FIG. 3, the S-shaped spring seal 60 has a forward U-shaped clamping portion 60*a* defining a radially outwardly open mouth for graspingly receiving aft leg 46. The forward clamping portion 60*a* has first and second clamping legs 61*a* and 61*b* connected by a first bow portion 63*a*. The second leg 61*b* of spring seal 60 is connected to a third leg 61*c* via a second bow portion 63*b* and formed therewith a spring loading portion 60*b*. The second bow portion 63*b* and the third leg 61*c* are lodged under an annular rim 62 extending axially forward from the rear radially outwardly extending flange 40 of the inner ring 36. The spring loading portion 60*b* pushes against the aft flange 40 of the inner ring 36, thereby biasing the front surface of the forward leg 44 into engagement with flange 38 to prevent air leakage therebetween at all conditions. In hot running condition, $P_a>P_b$ and $P_c>P_a$. By spring loading the vane ring 22 forward, the contact interface is maintained between the leg 44 and the flange 38 and since $P_c>P_a$, this contact interface can be used for sealing.

The S-shaped seal 60 has two axial contact points $C_1$ and $C_2$ with leg 46 and one axial contact point $C_3$ with flange 40. S-seal 60 also has two radial contact points $C_4$ and $C_5$ with the inner ring 36, one against the bottom surface of the cavity 42 and the other one against the undersurface of rim 62. The radial contact points $C_4$ and $C_5$ are used for sealing and fixing the seal 60 in cavity 42. The multiple point of contacts or sealing points provide improved sealing to prevent cooling air leakage from cavity 42 via the radial and axial gaps $G_R$ and $G_A$, which are designed to accommodate the thermal growth differential between vane ring 22 and inner ring 36 during engine operation. S-shaped seal 60 advantageously seals under all running conditions by accommodating thermal expansion.

In addition to its enhanced sealing function, the S-seal 60 provides the required forward spring force to push vane segments 26 forward in order to maintain the forward retention hooks 48 axially engaged with the forward flange 52 when there is no dynamic gas pressure, i.e. when the engine 10 is not running. Spring loading the inner ring 36 backwards also avoids any rubs at the leading edge of the vane ring 22 when the pressure $P_a$ is equal or near equal to $P_b$. Furthermore, it ensures that the brush seal 66 (FIG. 2) carried by the inner ring 36 remains on the hard coating 68 (FIG. 2) of a forward extension of the adjacent bladed rotor 20.

The principle advantages of S-seal 60 are: improved sealing efficiency, low cost and easy to assemble to the inner ring 36 and vane segments 26. During assembly, the vane segments 26 are first radially inserted into the inner ring 36 between the axially spaced-apart flanges 38 and 40 with the aft radially inwardly extending legs 46 of the segments 26 received in the forward U-shaped grasping portion 60*a* of the S-seal 60. The seal 60 has been previously fitted in radial compression between the rim 62 and the bottom surface of groove 42. Then, the vane segments 26 and the inner ring 36 are axially inserted as a single unit into outer case 19 so as to engage the forward hooks 48 onto the forward flange 52 and abut the front face of the aft reaction legs 50 against W-seal 58. Thereafter, the retainer 54 is radially engaged in groove 56 to prevent backward movement of the vane assembly. In use, the hot combustion gases flowing between inner band 30 and the outer band 32 pushes the reaction leg 50 radially outwardly against the case 19, thereby securing each vane segment 26 in place.

As mentioned above, the support ring 36 is preferably one-piece, and therefore preferably seal 60 is circumferentially discontinuous (i.e. includes at least one radial cut therethrough) to facilitate insertion as mentioned above. Where support 36 is provided in more than one piece, a circumferentially continuous seal 60 is preferably provided.

The above description is meant to be exemplary only, and one skilled in the art will recognize that changes may be made to the embodiments described without department from the scope of the invention disclosed. For example, various types of biasing members could be used to spring load the vane segments 26 relative to the inner ring 36 and to urge the aft leg 50 against the axial retainer 54. Also, the inner ring 36 does not necessarily have to be of unitary construction. The aft leg 50 could have various configuration has long as it does not require any special action to secure it in place. For instance, it could have an axial component. Still other modifications which fall within the scope of the present invention will be apparent to those skilled in the art, in light of a review of this disclosure, and such modifications are intended to fall within the appended claims.

The invention claimed is:

1. An arrangement for mounting a vane assembly to a gas turbine engine outer casing, the arrangement comprising a segmented vane ring pre-assembled on a one-piece inner ring to form with the one-piece inner ring a vane ring sub-assembly adapted to be directly mounted to the outer casing as a unitary component, and a biasing member mounted between the segmented vane ring and the one-piece inner ring, the biasing member axially loading the segmented vane ring against a rear facing surface of a forward flange of the one-piece inner ring.

2. The vane mounting arrangement as defined in claim 1, wherein the vane ring has a front and a rear end, the vane ring being hooked at one of said front and rear ends directly to the outer casing while being floatingly maintained in radial abutment relationship with the casing at another one of said front and rear ends by gas flow pressure during use.

3. The vane mounting arrangement as defined in claim 2, wherein said segmented vane ring is loosely received between the forward flange and an aft flange extending radially outwardly from said one-piece inner ring.

4. The vane mounting arrangement as defined in claim 1, wherein said biasing member includes a spring seal, said spring seal having multiple points of contact with said segmented vane ring and said one-piece inner ring.

5. The vane mounting arrangement as defined in claim 4, wherein said spring seal has two axial contact points with said segmented vane ring, and one axial and two radial contact points with said one-piece inner ring.

6. The vane mounting arrangement as defined in claim 5, wherein said spring seal is S-shaped.

7. The vane mounting arrangement as defined in claim 1, wherein said segmented vane ring comprises a plurality of circumferentially spaced-apart vanes extending radially between inner and outer arcuate bands, and wherein said outer band is provided with a forward retention hook adapted to be axially slid in engagement with a forward flange provided on an inner surface of said outer casing, and wherein pressure from gas flow between the inner and outer bands induces a rotation about the forward retention hook, which rotation is counteracted by an aft leg extending radially outwardly from the outer band for radial abutment against the inner surface of the outer casing.

8. The vane mounting arrangement as defined in claim 7, wherein said aft leg axially abuts against an axial retainer removably mounted in a radially inwardly facing slot defined in the inner surface of the outer casing to retain the vane ring sub-assembly against backward movement.

9. The vane mounting arrangement as defined in claim 8, wherein a spring seal biases said aft leg axially rearwardly against said axial retainer.

10. The vane mounting arrangement as defined in claim 7, wherein said one-piece inner ring has an aft radially outwardly extending flange, and wherein said segmented vane ring is mounted between said forward and aft flanges.

11. The vane mounting arrangement as defined in claim 10, wherein said segmented vane ring is spring loaded against said forward flange by the biasing member, the biasing member extending between said aft flange and said segmented vane ring.

12. The vane mounting arrangement as defined in claim 11, wherein said segmented vane ring has an aft leg extending radially inwardly from the inner band, and wherein said aft leg of said segmented vane ring is graspingly received in a radially outwardly facing mouth defined by said biasing member.

13. The vane mounting arrangement as defined in claim 12, wherein said biasing member includes a spring seal having a S-shaped configuration.

14. A stationary vane ring assembly for a gas turbine engine, comprising a vane ring having a number of circumferentially spaced-apart vanes extending radially between inner and outer arcuate bands, the vane ring being mounted to an inner ring to form with the inner ring a pre-assembled vane ring sub-assembly, the pre-assembled vane ring sub-assembly being mountable as a unit directly to an outer casing, wherein the inner ring is of unitary construction and comprises forward and aft radially outwardly extending flanges, said vane ring having a radially innermost end portion received between said forward and aft flanges, and wherein a biasing member extends between said radially innermost end portion, and one of said forward and aft radially outwardly extending flanges, the biasing member pushing the vane ring forwardly against the forward flange of the inner ring.

15. The stationary vane ring assembly as defined in claim 14, wherein the vane ring is radially supported at one of a front and a rear end thereof directly by the outer casing while being floatingly maintained in radial abutment relationship with the outer casing at another one of said front and rear ends by gas flow pressure during use.

16. The stationary vane ring assembly as defined in claim 15, wherein said outer band is provided with a forward retention hook adapted to be axially slid in engagement with a forward flange provided on an inner surface of said outer casing, and wherein an aft leg extends radially outwardly from said outer band for radially abutting against the outer casing, and wherein an axial retainer is removably mounted in a radially inwardly facing groove defined in the outer casing, the aft leg axially abutting against the axial retainer to restrain backward movement of the vane ring.

17. The stationary van ring assembly as defined in claim 16, wherein a second biasing member urges the aft leg axially rearwardly against said axial retainer.

18. A gas turbine vane mounting arrangement comprising: a vane ring comprising circumferentially spaced-apart vanes extending radially between inner and outer arcuate bands, the vane ring being hooked at one of a front and a rear end thereof directly to an outer casing of the gas turbine while being floatingly maintained in radial abutment relationship with the outer casing at another one of said front and rear ends by gas flow pressure during use, an axial retainer removably mounted in a radially inwardly facing groove defined in an inner surface of the outer casing to restrain the vane ring against axial movement, and a biasing member provided for biasing said vane ring against said axial retainer.

19. The vane mounting arrangement as defined in claim 18, wherein said vane ring is segmented and mounted to a one-piece inner ring.

20. The vane mounting arrangement as defined in claim 19, wherein said vane ring is mounted to said one-piece inner ring to form therewith a pre-assembled vane sub-assembly, and wherein said vane sub-assembly is mountable as a single unit to the outer casing.

21. The vane mounting arrangement as defined in claim 19, wherein said one-piece inner ring has forward and aft radially outwardly extending flanges defining a vane ring receiving cavity, and wherein said segmented vane ring is mounted between said forward and aft flanges.

22. The vane mounting arrangement as defined in claim 21, wherein a biasing member is provided in said vane receiving cavity between one of said forward and aft flanges and said vane ring.

23. The vane mounting arrangement as defined in claim 22, wherein said biasing member includes a spring seal.

24. The vane mounting arrangement as defined in claim 23, wherein said spring seal is S-shaped and has multiple points of contact with said vane ring and said one-piece inner ring.

25. The vane mounting arrangement as defined in claim 24, wherein a leg extends radially inwardly from said inner bands, and wherein said S-shaped spring seal graspingly engages said leg.

26. The vane mounting arrangement as defined in claim 25, wherein said S-shaped spring seal has two axial points of contact with said leg and one axial point of contact with said inner ring, and wherein said S-shaped spring seal has two radial points of contact with said inner ring.

27. The vane mounting arrangement as defined in claim 24, wherein said aft flange of said inner ring has an axially extending flange under which said S-shaped spring seal is engaged.

28. The vane mounting arrangement as defined in claim 18, wherein said vane ring is hooked to the outer casting via a retention hook extending from the outer band for axial engagement with a corresponding axial flange provided on an inner surface of the outer casing, and wherein a biasing member urges said retention hook in axial engagement with said axial flange.

29. A method of assembling a stage of gas turbine engine stationary vanes, the method comprising the steps of: a) assembling a number of vane ring segments to a one-piece inner ring to form a pre-assembled vane ring sub-assembly, comprising mounting a biasing member between the one-piece inner ring and the vane ring segments to axially spring load the vane ring segments axially forwardly against a forward flange of the one-piece inner ring, and then b) installing the pre-assembled vane ring sub-assembly as a unit in an outer casing.

30. The method defined in claim 29, comprising the step of directly mounting the pre-assembled vane ring sub-assembly to an inner surface of the casing.

31. The method defined in claim 30, comprising the step of mounting an axial retainer in an inwardly facing groove defined in the outer casing after the vane ring sub-assembly has been axially slid in place therein, and biasing the vane ring segments axially rearwardly against the axial retainer.

32. The method as defined in claim 29, wherein the one-piece inner ring also includes an aft flange and wherein step a) comprises the step of radially inserting the vane ring segments into the one-piece inner ring between the forward and aft flange flanges.

33. A vane assembly for a gas turbine engine, the vane assembly comprising:

a plurality of airfoils extending between an inner platform and an outer platform;

at least one hook extending radially outward from the outer platform and adapted to hookingly engage the gas turbine engine; and at least one reaction leg extending radially outward from the outer platform and adapted to abut the gas turbine engine when the hook hookingly engages the gas turbine engine, wherein the hook and reaction leg are positioned on the vane assembly such that, in use, pressure exerted on the vane assembly by combustion gases exiting an upstream combustor urges the reaction leg into contact with the gas turbine engine, wherein a spring seal biasing member axially spring load the reaction leg in a rearward direction.

* * * * *

UNITED STATES PATENT AND TRADEMARK OFFICE

CERTIFICATE OF CORRECTION

PATENT NO. : 7,238,003 B2
APPLICATION NO. : 10/923680
DATED : July 3, 2007
INVENTOR(S) : Remy Synnott et al.

It is certified that error appears in the above-identified patent and that said Letters Patent is hereby corrected as shown below:

Claim 28, column 7, line 25, delete “casting” insert --casing--

Signed and Sealed this

Fourth Day of September, 2007

JON W. DUDAS
*Director of the United States Patent and Trademark Office*